US008844145B2

(12) United States Patent
Psimadas et al.

(10) Patent No.: US 8,844,145 B2
(45) Date of Patent: Sep. 30, 2014

(54) RAZOR HANDLE FOR A RETRACTABLE SHAVING CARTRIDGE AND A RAZOR COMPRISING SUCH A RAZOR HANDLE

(75) Inventors: Ioannis Marios Psimadas, Vrilissia-Athens (GR); Ioannis Bozikis, Koukaki-Athens (GR); Dimitrios Efthimiadis, Nea Kypseli-Athens (GR); Demetrios Koutrokois, Glyfada-Athens (GR); Andreas Vasiliadis, Chalandri-Athens (GR)

(73) Assignee: Bic-Violex SA, Anixi, Attiki (GR)

( * ) Notice: Subject to any disclaimer, the term of this patent is extended or adjusted under 35 U.S.C. 154(b) by 533 days.

(21) Appl. No.: 12/937,292

(22) PCT Filed: Apr. 11, 2008

(86) PCT No.: PCT/EP2008/054439

§ 371 (c)(1),
(2), (4) Date: Oct. 11, 2010

(87) PCT Pub. No.: WO2009/124597

PCT Pub. Date: Oct. 15, 2009

(65) Prior Publication Data

US 2011/0023310 A1 Feb. 3, 2011

(51) Int. Cl.

| | |
|---|---|
| ***B26B 19/00*** | (2006.01) |
| ***B26B 21/00*** | (2006.01) |
| ***B26B 21/52*** | (2006.01) |
| ***B26B 21/40*** | (2006.01) |
| ***B26B 21/22*** | (2006.01) |

(52) U.S. Cl.

CPC ..... *B26B 21/4062* (2013.01); *B26B 21/4012* (2013.01); *B26B 21/521* (2013.01); *B26B 21/225* (2013.01); *B26B 21/528* (2013.01); *B26B 21/522* (2013.01)

USPC ..... 30/526; 30/527; 30/34.1

(58) Field of Classification Search

USPC ..... 30/34.1, 47, 50, 51, 526, 527, 529–533

See application file for complete search history.

(56) References Cited

U.S. PATENT DOCUMENTS

| | | | | |
|---|---|---|---|---|
| 3,795,979 | A | 3/1974 | Perry | |
| 3,997,967 | A | 12/1976 | De Boer | |
| 4,504,707 | A * | 3/1985 | Ochiai | 200/43.17 |
| 5,157,834 | A * | 10/1992 | Chen et al. | 30/532 |
| 5,182,858 | A * | 2/1993 | Chen | 30/530 |
| 5,206,994 | A * | 5/1993 | Lin | 30/47 |

(Continued)

FOREIGN PATENT DOCUMENTS

| | | |
|---|---|---|
| DE | 20 2004 001 085 U1 | 6/2004 |
| EP | 1 458 001 A1 | 9/2004 |

(Continued)

*Primary Examiner* — Ghassem Alie
*Assistant Examiner* — Bharat C Patel
(74) *Attorney, Agent, or Firm* — Jones Day

(57) ABSTRACT

A razor handle for a retractable shaving cartridge that includes an elongated body having a hollow housing provided with an opening at the front end of the body, and a shaving cartridge carrier movable between a shaving position and a non-shaving position. A release mechanism that includes an actuating member is provided to actuate the release mechanism so as to release a shaving cartridge. In addition, a control mechanism includes a control member for controlling the actuating member only when the shaving cartridge carrier is in the shaving position. The elongated body further includes a guide adapted for guiding the control member.

12 Claims, 14 Drawing Sheets

(56) References Cited

U.S. PATENT DOCUMENTS

| | | | | |
|---|---|---|---|---|
| 5,465,488 | A * | 11/1995 | Yaw et al. | 30/41 |
| 5,608,972 | A * | 3/1997 | Tsae-Chyn | 30/526 |
| 6,115,924 | A * | 9/2000 | Oldroyd | 30/527 |
| 6,434,839 | B1 * | 8/2002 | Lee et al. | 30/532 |
| 7,093,363 | B1 * | 8/2006 | Kuo | 30/47 |
| 7,685,720 | B2 * | 3/2010 | Efthimiadis et al. | 30/527 |
| 2003/0233754 | A1 | 12/2003 | Braun et al. | |
| 2004/0118724 | A1 * | 6/2004 | Leventhal et al. | 206/352 |
| 2007/0180699 | A1 * | 8/2007 | Psimadas et al. | 30/34.1 |

FOREIGN PATENT DOCUMENTS

| | | | |
|---|---|---|---|
| GB | 2 116 470 | A | 9/1983 |
| WO | WO 2005/090017 | A1 | 9/2005 |
| WO | WO 2005090017 | A1 * | 9/2005 |
| WO | WO 2009/124597 | | 10/2009 |

* cited by examiner

RAZOR HANDLE FOR A RETRACTABLE SHAVING CARTRIDGE AND A RAZOR COMPRISING SUCH A RAZOR HANDLE

CROSS REFERENCE TO RELATED APPLICATION

This application is a national stage application of International Application No. PCT/EP2008/054439, filed on Apr. 11, 2008, the contents of the application being incorporated herein by reference.

FIELD OF THE INVENTION

The embodiments of the present invention are related to a razor handle for a retractable shaving cartridge and a razor having such a razor handle.

BACKGROUND OF THE EMBODIMENTS OF THE PRESENT INVENTION

In order to avoid any involuntary release of the shaving cartridge when the razor handle in not used, some of the razor handles have been provided with a control mechanism for controlling the actuating member only when the shaving cartridge carrier is in the shaving position, such as disclosed in WO2005/090017. This patent application discloses a razor having at least two slidable shaving cartridges and a control mechanism for each shaving cartridge. Each control mechanism comprises flexible release buttons provided on the body which can activate the release mechanism only when the shaving cartridge carrier is in the shaving position.

SUMMARY OF THE EMBODIMENTS OF THE PRESENT INVENTION

The embodiments of the present invention relate to a razor handle for a retractable shaving cartridge comprising an elongated body extending in a longitudinal direction between a front end and a back end and having an upper and a lower face, the body having a hollow housing provided with an opening at the front end of the body, a shaving cartridge carrier movable between a shaving position in which the razor cartridge carrier extends at least partly out of the housing, and a non-shaving position in which the razor cartridge carrier is retracted inside the housing, a release mechanism provided on the shaving cartridge carrier and including an actuating member which is adapted to actuate the release mechanism so as to release a shaving cartridge carried by the shaving cartridge carrier, and a control mechanism which is disposed on the body for controlling the actuating member only when the shaving cartridge carrier is in the shaving position, the control mechanism comprising a release button movably mounted on the elongated body between a rest position and a release position. The control mechanism further includes a control member movably mounted between a retracted position in which the control member does not interfere with the actuating member of the release mechanism and an active position in which the control member is positioned to act on the actuating member upon actuation of the release button when the shaving cartridge carrier is in the shaving position.

Such a razor handle allows a shaving cartridge connected to the shaving cartridge carrier to be located inside the housing when the razor in not used, hence protecting the shaving cartridge from any aggressive environment.

An object of an embodiment of the present invention is to provide a razor handle in which the release buttons provided on the body can activate the release mechanism only when the shaving cartridge carrier is in the shaving position.

This problem is solved by the fact that the control member is movably mounted on the release button and the elongated body further includes at least a guide adapted for guiding the control member so that the control member be in the retracted position when the release button is in the rest position and in the active position when the release button is in the release position.

Consequently, the control member is guided when moved between its retracted and active positions.

In various embodiments of the present invention, one and/or the other of the following features may be incorporated:

- the release button is slidably mounted in the longitudinal direction on the elongated body between the rest position and the release position, the release position being closer to the front end of the elongated body than the rest position and the release button being elastically biased toward the back end, the control member being pivotally mounted relative to the release button between the retracted position and the active position in which the control member is positioned to push the actuating member toward the front end of the body,
- the release mechanism comprises at least two arms for connecting a shaving cartridge to the shaving cartridge carrier, the arms extending substantially symmetrically on both sides of a medial axis, the arms being elastically biased opposite to one another toward a cartridge locking position and movable toward one another into a cartridge release position, and the actuating member preferably has at least two pins slidably engaged in at least two cam recesses provided on the arms and formed to allow the biasing of the arms toward the head locking position when the actuating member is pushed toward the front end of the body,
- the razor cartridge carrier further comprises lateral flanges extending forward at the front end of the body, at least as far as the at least two arms, the at least two arms being situated between the at least two lateral flanges,
- the razor handle further comprises a carrier button which is slidably mounted in the longitudinal direction on the elongated body for controlling the shaving cartridge carrier motion, the carrier button being movable between a first position in which the shaving cartridge carrier is in the non-shaving position and a second position in which the shaving cartridge carrier is in the shaving position, the second position being closer to the front end of the elongated body than the first position,
- the release button is provided on the upper face of the body, whereas the carrier button is provided on the lower face of the body, and a finger rest pad is provided on the upper face of the body near the release button,
- the razor handle further comprises a locking mechanism adapted to lock the shaving cartridge carrier either in the non-shaving or in the shaving position, the carrier button being able to actuate the locking mechanism to unlock the shaving cartridge carrier from the non-shaving position or from the shaving position,
- the locking mechanism comprises at least two recesses provided on the housing and a spring tongue connected to the carrier button and to the shaving cartridge carrier, the spring tongue having a free end which is retained in one of the at least two recesses when the shaving cartridge carrier is in the non-shaving, and in the other of the at least two recesses when the shaving cartridge carrier is in the shaving position, the body preferably has a variable width along a length, the body comprising an enlarged part and a slim part connected together by a neck, the neck being located at a distance of the front end which is comprised between 10% and 20% of an overall length of the razor handle, the enlarged part extending from this neck to the front end, whereas the slim part extends from the back end to this neck.

The embodiments of the present invention also relate to a razor comprising such a razor handle and a shaving cartridge connected to the shaving cartridge carrier.

The shaving cartridge is preferably connected to shaving cartridge carrier such that the shaving cartridge extends out of the razor handle when the shaving cartridge carrier is in the shaving position and the shaving cartridge is located inside the housing when the shaving cartridge carrier is in the non-shaving position, and the release mechanism is preferably adapted to release the shaving cartridge only when the shaving cartridge carrier is in the shaving position. The shaving cartridge can further be provided with rearwardly protruding ribs connected to the razor handle and partly covered by the at least two lateral flanges of the razor handle when the shaving cartridge is connected to the shaving cartridge carrier.

The above and other objects and advantages of the embodiments of the present invention will become apparent from the detailed description of an embodiment of the present invention, considered in conjunction with the accompanying drawings.

BRIEF DESCRIPTION OF THE DRAWINGS

FIG. 7A is a partial longitudinal section of the razor of FIG. 1C, the shaving cartridge carrier being in the non-shaving position and the control member being in the active position.

FIG. 7C' is a partial longitudinal section of the razor of FIG. 1B, the shaving cartridge carrier being in the shaving position and the control member being in the active position.

DETAILED DESCRIPTION OF THE EMBODIMENTS OF THE PRESENT INVENTION

In the various figures, the same references denote identical or similar elements.

Figure 1A:
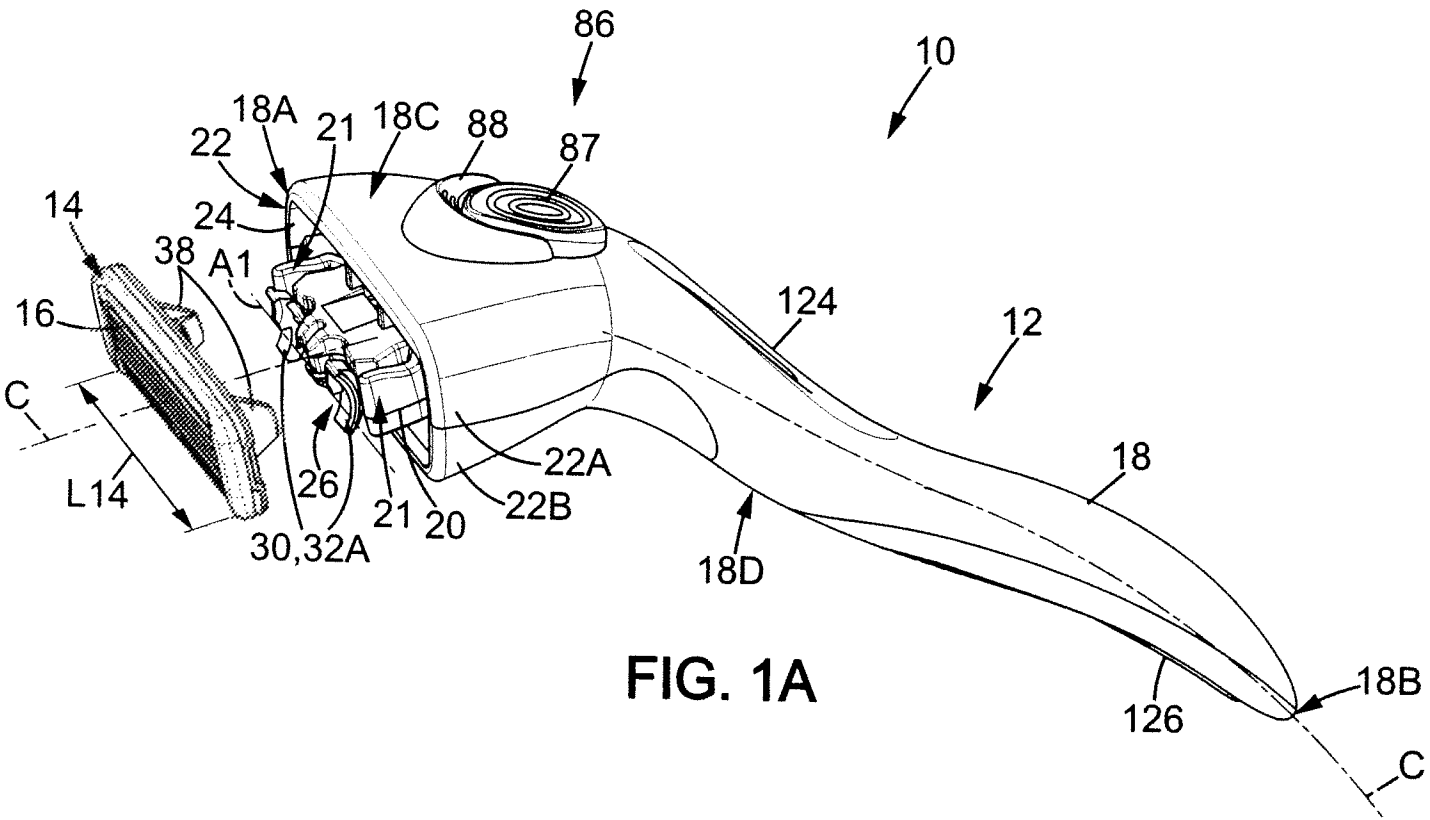
FIG. 1A is a perspective view of the shaving razor according to an embodiment of the present invention, the shaving cartridge carrier being in the shaving position and the shaving cartridge being released.

FIG. 1A illustrates a razor 10 according to the embodiment present invention, having a razor handle 12 and a shaving cartridge 14 provided with one or several shaving blades 16.

The razor handle 12 preferably has an elongated body 18 extending in a longitudinal direction L between a front end 18A and a back end 18B. The body 18 preferably has an upper face 18C opposite to a lower face 18D.

Figure 1B:
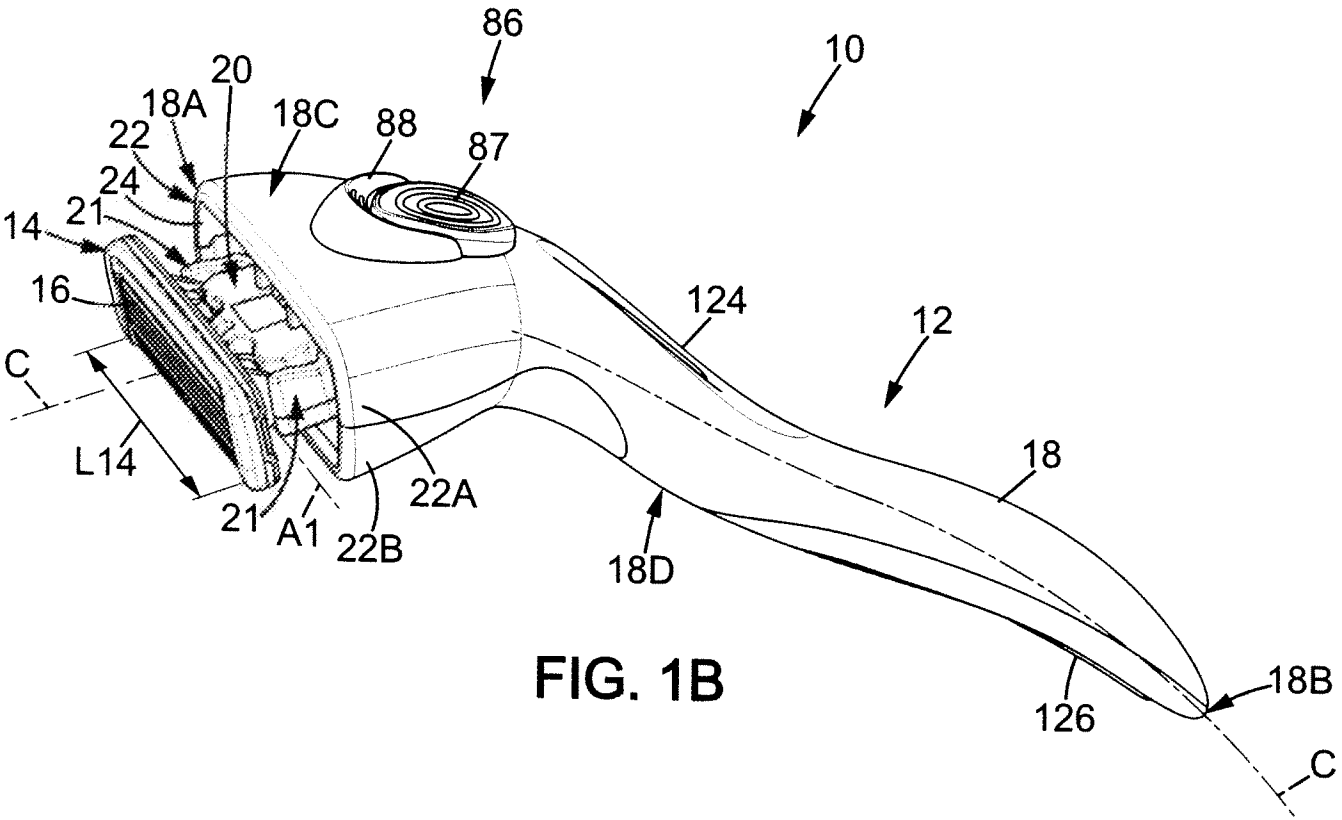
FIG. 1B is a perspective view of the razor shown in FIG. 1A, the shaving cartridge carrier being in the shaving position and the shaving cartridge being connected to the shaving cartridge carrier.

The shaving cartridge 14 is preferably a disposable cartridge which can be connected to a shaving cartridge carrier 20 as illustrated on FIG. 1B.

Figure 1C:
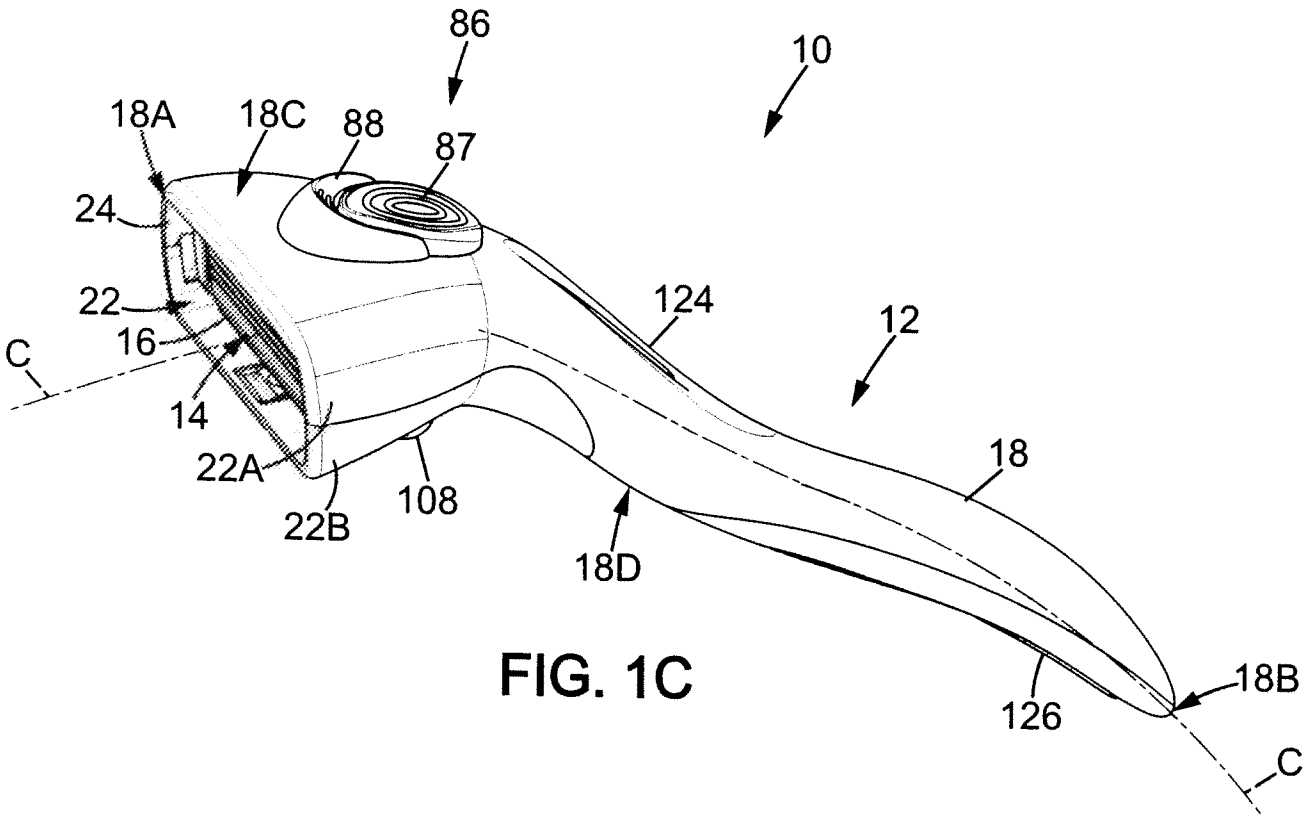
FIG. 1C is a perspective view of the razor shown in FIG. 1A, the shaving cartridge carrier being in the non-shaving position and the shaving cartridge being connected to the shaving cartridge carrier.

This shaving cartridge carrier 20 is movable between a shaving position (depicted on FIG. 1A or 1B) in which the razor cartridge carrier 20 and the shaving cartridge 14 extend at least partly out of a housing 22 provided on the body 18, and a non-shaving position (depicted on FIG. 1C) in which the razor cartridge carrier 20 and the shaving cartridge 14 are retracted inside the housing 22.

Figure 2:
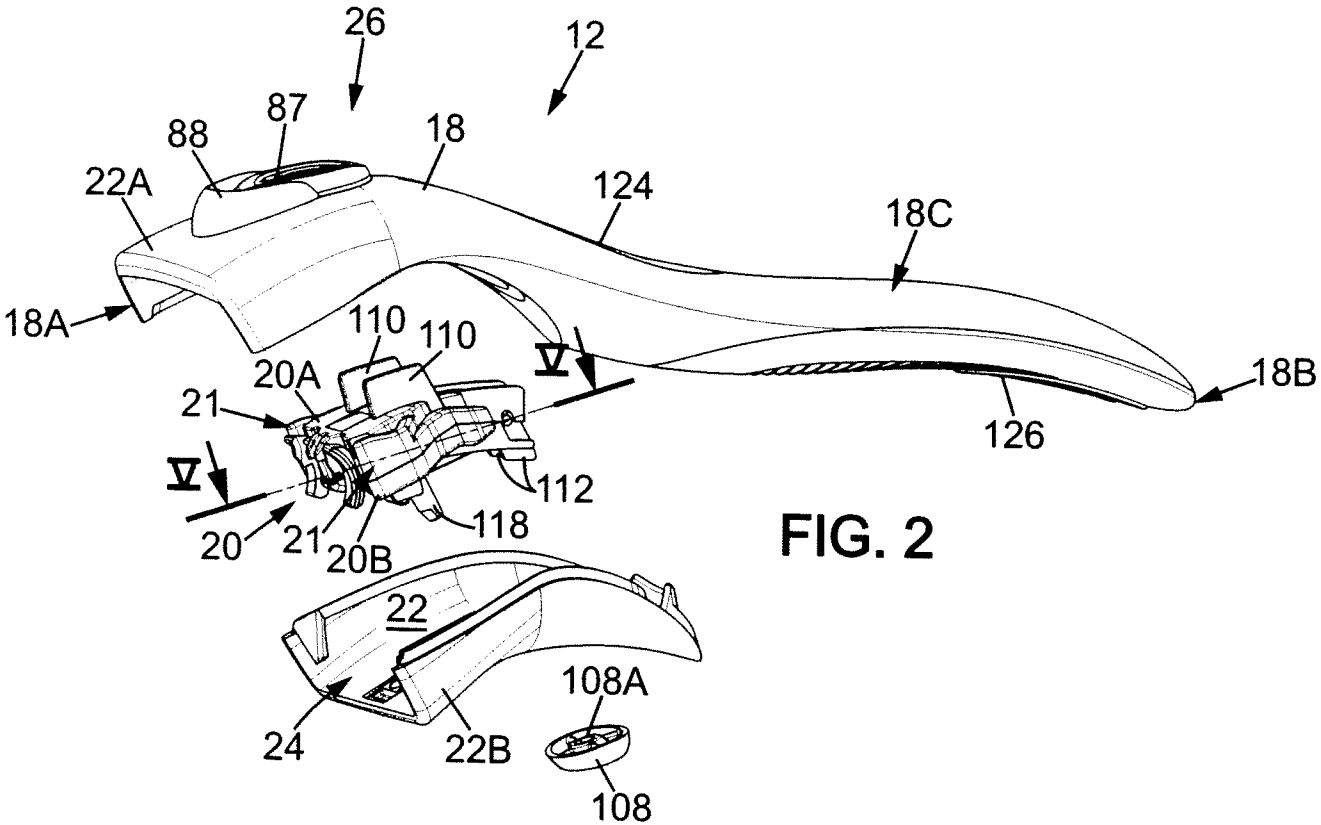
FIG. 2 is a perspective view partially exploded of the razor shown in FIG. 1A (without the shaving cartridge).

The housing 22 is hollow and preferably formed by an upper shell 22A and a lower shell 22B as illustrated on FIG. 2 which are maintained together in a well-known way like for example by snap-fitting or gluing. An opening 24 at the front end 18A of the body 18 allows access to the inside of this hollow housing 22. Especially, the shaving cartridge carrier 20 is movable through this opening 24.

In order to be able to connect or release the shaving cartridge 14 especially in order to exchange it, the handle 12 is further provided with a release mechanism 26 provided on the shaving cartridge carrier 20. As illustrated in detail on FIG. 3, the release mechanism 26 includes an actuating member 28 which is adapted to actuate the release mechanism 26 so as to release the shaving cartridge 14 (not illustrated) carried on the shaving cartridge carrier 20.

Figure 3:
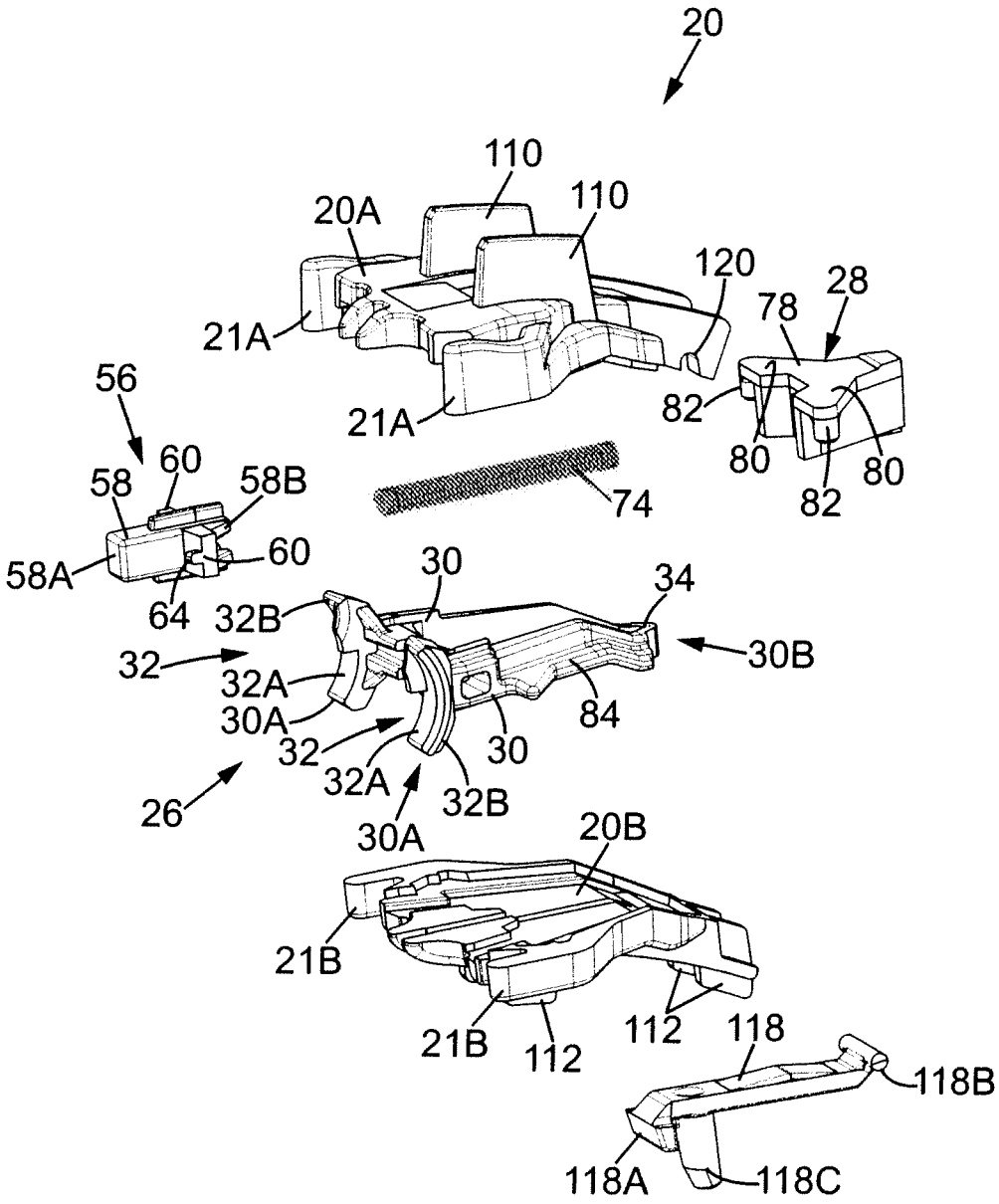
FIG. 3 is an exploded perspective view of the shaving cartridge carrier shown in FIG. 2.
Figure 4A:
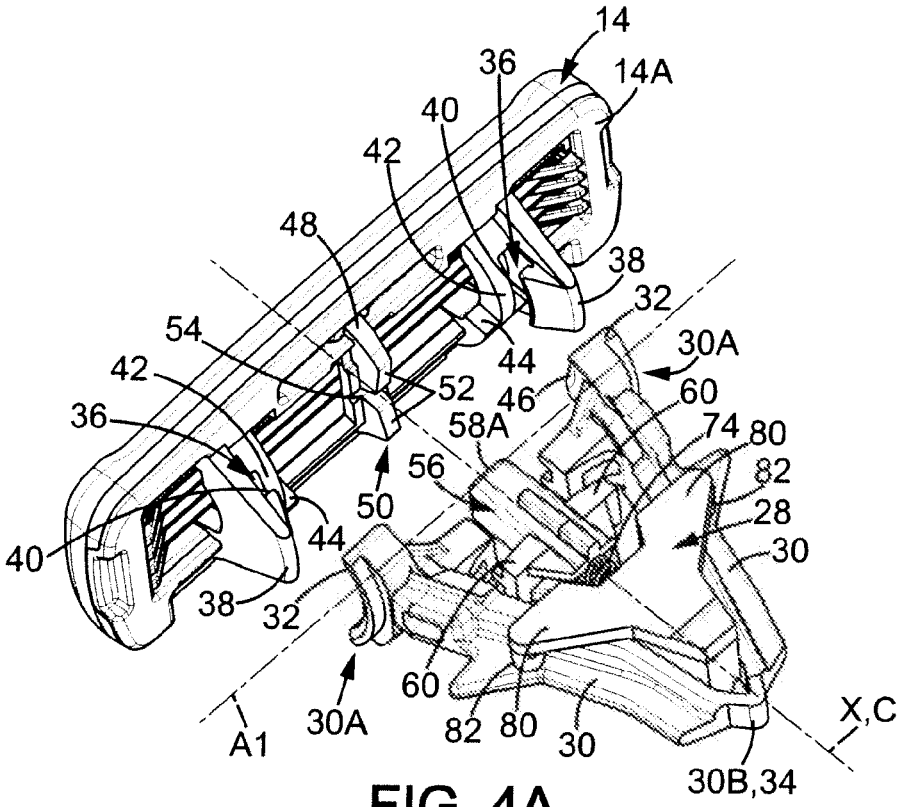
FIG. 4A is a partial perspective view of the shaving cartridge carrier shown in FIG. 2, the shaving cartridge being released from the shaving cartridge carrier.
Figure 4B:
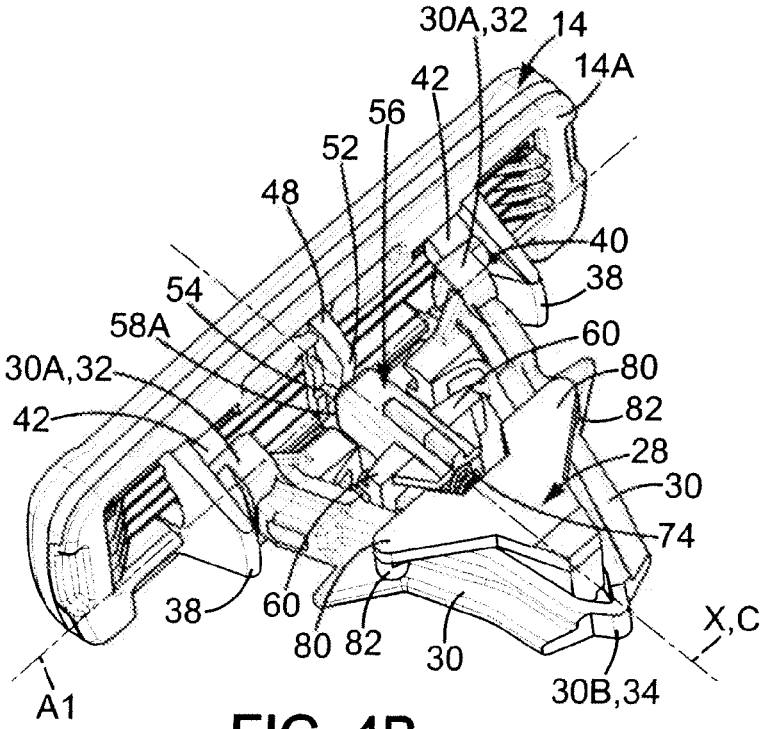
FIG. 4B is a partial perspective view of the shaving cartridge carrier shown in FIG. 2, the shaving cartridge being connected to the shaving cartridge carrier.

In reference to FIGS. 3, 4A and 4B, the release mechanism 26 comprises at least two arms 30 and 30 for connecting a shaving cartridge 14 to the shaving cartridge carrier 20. The arms 30 are elastically biased opposite to one another toward a cartridge locking position (see FIG. 4B) and movable toward one another into a cartridge release position (see FIG. 4A).

Each arm 30 preferably has a first end 30A including preferably shell bearings 32 having a cylindrical concave front face 32A and a lateral edge 32B which protrudes outwardly and which also preferably has a cylindrical shape. The front face 32A and the lateral edge 32B have the same cylindrical axis, corresponding to the axis of rotation Al of the shaving cartridge 14. The two arms 30 and 30 may be disposed in a V shape, converging from a medial axis X from their first end 30A toward a second end 30B. The medial axis X is substantially parallel to the curved longitudinal axis C of the handle 12. The second ends 30B of the two arms 30 may be connected together by a hinge 34, formed for instance as a thin bridge of plastic material connecting the arms 30 to each other when the arms are molded as a single piece. The hinge 34 may have a negligible resilient action, or no resilient action, on the arms 30.

As shown in FIG. 4A, the rear face 14A of the shaving cartridge 14 may include at least two inwardly facing arcuate slots 36 shaped in correspondence with the lateral edges 32B of the shell bearings 32 and adapted to receive the lateral edges 32B for pivotally mounting the shaving cartridge 14 onto the handle 12. These arcuate slots 36 may be formed respectively in at least two protruding ribs 38 and may be limited toward the handle 12, by a first arcuate concave surface 40 facing toward the shaving cartridge 14, and away from the handle 12, by a larger second arcuate convex surface 42 facing toward the handle 12.

When the shaving cartridge 14 is connected to the shaving cartridge carrier 20, these rearwardly protruding ribs 38 are partly covered by at least two lateral flanges 21 provided on the razor handle 12. More specifically the lateral flanges 21 can be provided on the shaving cartridge carrier 20 and extend forward at the front end 18A of the handle body 18 in the direction of the shaving cartridge 14, at least as far as the two arms 30, the arms 30 being situated between the two lateral flanges 21. The rearwardly protruding ribs 38 and the lateral flanges 21 are preferably shaped in correspondence to partly cover the protruding ribs 38.

These lateral flanges 21 improve the retention of the shaving head 14 on the razor handle 12 and guide the user during the connection of the shaving cartridge on the razor handle 12. In addition, the movement generated by the shaving in the connection can be at least partly absorbed by the flanges 21. The front faces 32A of the shell bearings 32 bear respectively on the second arcuate convex surfaces 42. The second arcuate convex surfaces 42 may include respectively at least two notches 44 for receiving corresponding protrusions 46 of the shell bearings 32, so as to limit the angular range of rotation of the shaving cartridge 14. The rear face 14A of the shaving cartridge 14 may further include a central rib 48 having an edge forming a top cam surface 50 facing away from the shaving cartridge 14 toward the handle 12. The cam surface 50 may have a generally V shape and may include at least two substantially flat surfaces 52 which are slightly inclined relative to one another and which may be for instance separated from one another by a notch 54 hollowed out in the rib 48 in order to adapt the shaving cartridge 14 on another type of handle having a flexible tongue which is inserted into the notch 54.

Figure 5:
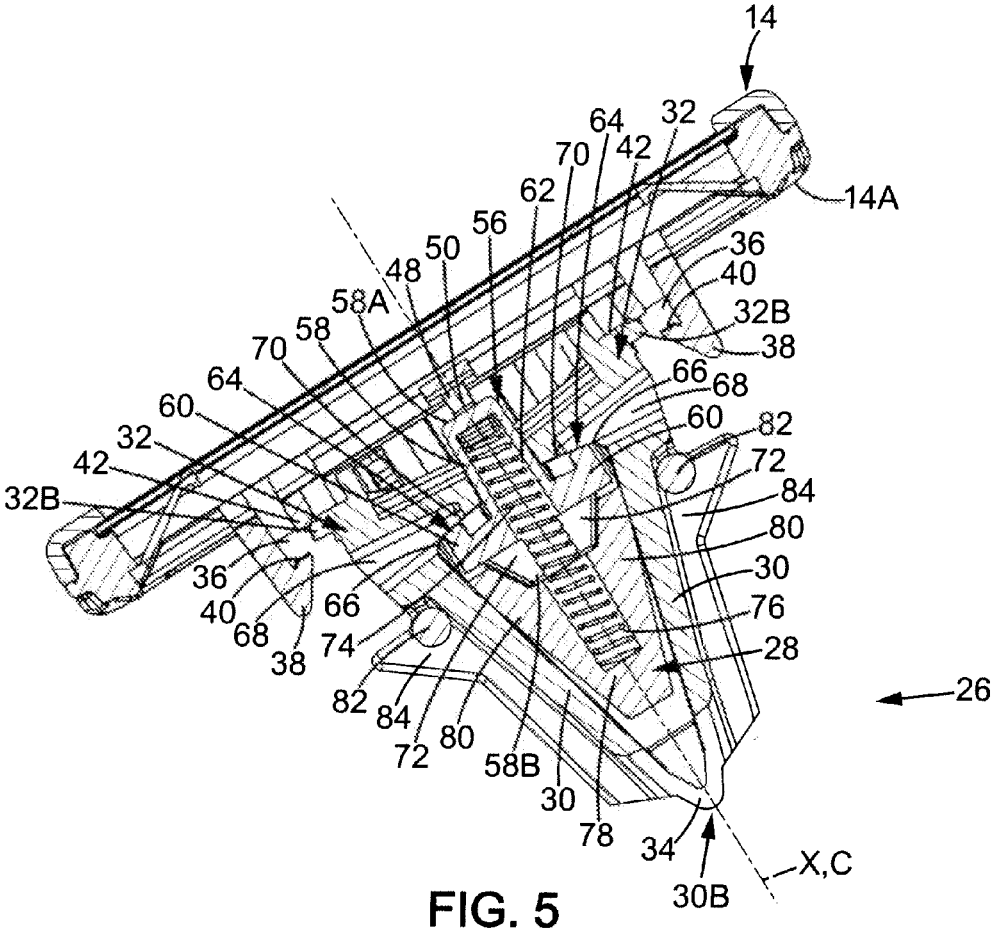
FIG. 5 is a partial longitudinal section of the shaving razor carrier of FIG. 2 along line V-V.

In reference to FIGS. 3 and 5, the release mechanism 26 further includes a plunger 56 which is movably mounted, substantially along the medial axis X between the at least two arms 30. This plunger 56 preferably has a central body 58 and at least two lateral wings 60 extending opposite to one another toward the at least two arms 30. The central body 58 extends longitudinally parallel to the medial axis X, between a first, substantially flat free end 58A which bears against the cam surface 50 of the shaving cartridge 14 (see FIG. 4A), and a second end 58B facing away from the shaving cartridge 14.

A recess 62 may be hollowed out in the central body 58, the recess 62 forming a blind hole which opens at the second end 58B of the central body 58, in the direction of the handle 12. Each lateral wing 60 may include a detent 64 protruding parallel to the medial axis X toward the shaving cartridge 14, the detent 64 facing an inwardly extending protrusion 66 belonging to the corresponding arm 30. The protrusion 66 preferably has an opening 68 which is limited inwardly by a rim 70 belonging to the protrusion 66. In addition, the lateral wings 60 of the plunger 56 may each have respectively at least two ribs 72 which extend in a medial plane of the arms 30, opposite to the central body 58.

The plunger 56 is elastically biased toward the cam surface 50 of the shaving cartridge 14 so as to cooperate therewith by camming action to bias the shaving cartridge 14 in rotation toward a rest position. In the example shown in the figures, the plunger 56 is elastically biased by a helicoidal spring 74, which preferably has a first spring end fitted into the recess 62 and a second spring end fitted into a recess 76, for instance in the form of a blind hole, hollowed out in the actuating member 28.

The actuating member 28 is disposed between the arms 30 in line with the plunger 56 along the medial axis X. The actuating member 28 is disposed between the plunger 56 and the hinge 34 along the medial axis X. The recess 76 opens parallel to the medial axis X toward the plunger 56.

The actuating member 28 is slidably mounted between the arms 30, substantially parallel to the medial axis X and is elastically biased by the spring 74 toward the handle 12, i.e. away from the shaving cartridge 14. The actuating member 28 cooperates by camming action with the at least two arms 30 for biasing the arms 30 outwardly away from each other, toward a cartridge locking position shown in FIG. 4B, where lateral edges 32B of the shell bearings 32 penetrate in the corresponding arcuate slots 36 of the shaving cartridge 14.

The actuating member 28 preferably has a central body 78 in which the recess 76 is hollowed out, and at least two lateral extensions 80 extending opposite to one another toward the two arms 30 and cooperating by camming action respectively with the two arms 30 for biasing the arms toward the cartridge locking position. These lateral extensions 80 are provided with a respective pin 82 (see FIGS. 3 and 5) slidably engaged in at least two respective cam recesses 84 provided on the arms 30 and formed to allow the biasing of the arms toward the head locking position when the actuating member is pushed toward the front end of the body. The cam recesses 84 may be diverging from the medial axis X in a direction away from the handle 12.

Thanks to these dispositions, the same spring 74 is used to bias the plunger 56 elastically toward the cam surface 50 of the shaving cartridge 14 and to bias the actuating member 28 away from the shaving cartridge 14, thus biasing both the shaving cartridge 14 in rotation toward the rest position and the arms 30 toward the cartridge lock position. It should be noted that the plunger 56 is maintained between the two arms 30 both by cooperation with the spring 74 by abutment against the cam surface 50 of the shaving cartridge 14 and eventually by abutment against the protrusions 66 of the arms 30.

Referring back to FIG. 1A, the razor handle 12 is further provided with a control mechanism 86 which is disposed on the body 18 for controlling the actuating member 28.

Figure 6A:
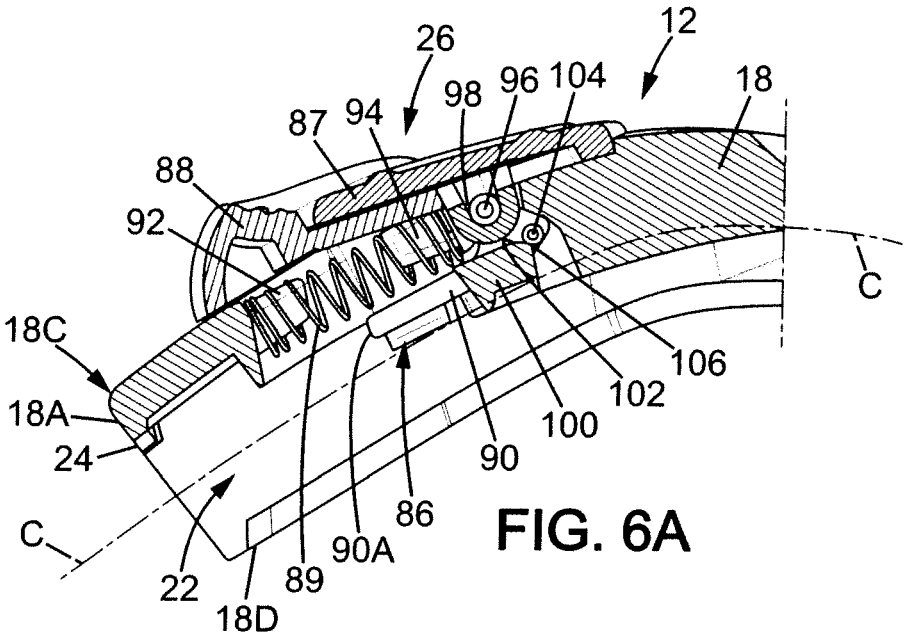
FIG. 6A is a partial longitudinal section of the razor of FIG. 1A, the release button being in the rest position.
Figure 6B:
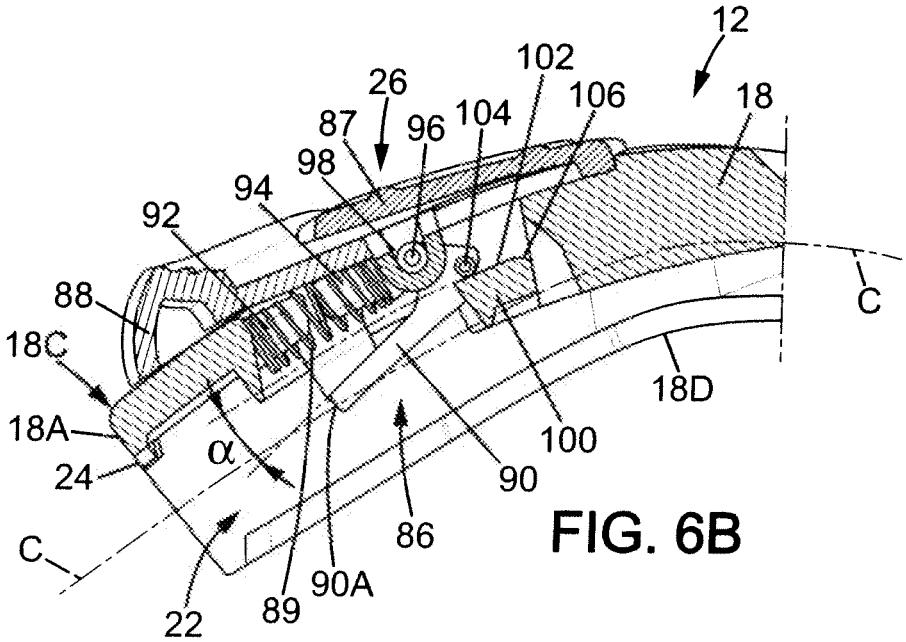
FIG. 6B is a partial longitudinal section of the razor of FIG. 1A, the release button being in the release position.

The control mechanism 86 comprises a release button 88 movably mounted on the elongated body 18 between a rest position illustrated on FIG. 6A and a release position illustrated on FIG. 6B.

The release button 88 may be slidably mounted in the longitudinal direction L on the elongated body 18 between the rest position and the release position, the release position being closer to the front end 18A of the elongated body 18 than the rest position. In the example shown in the figures, the release button 88 is elastically biased by a helicoidal spring

89, which preferably has a first spring end fitted around a lug 92 provided on the body 18 and a second spring end fitted around a lug 94 provided on the release button 88. The release button 88 is thus elastically biased by the spring 89 toward the handle 12, i.e. away from the shaving cartridge 14, in its rest position (FIG. 6A).

The control mechanism 86 further comprises a control member 90 movably mounted on the release button 88 between a retracted position illustrated on FIG. 6A and an active position illustrated on FIG. 6B. As disclosed in detail hereafter and in reference to FIGS. 7A-7D, this control member 90 is able to push the actuating member 28 according to its position: in its retracted position, the control member 90 does not interfere with the actuating member 28 and in its active position, the control member 90 is positioned to be able to act on the actuating member 28 in pushing it toward the front end 18A of the body 18.

Figure 6C:
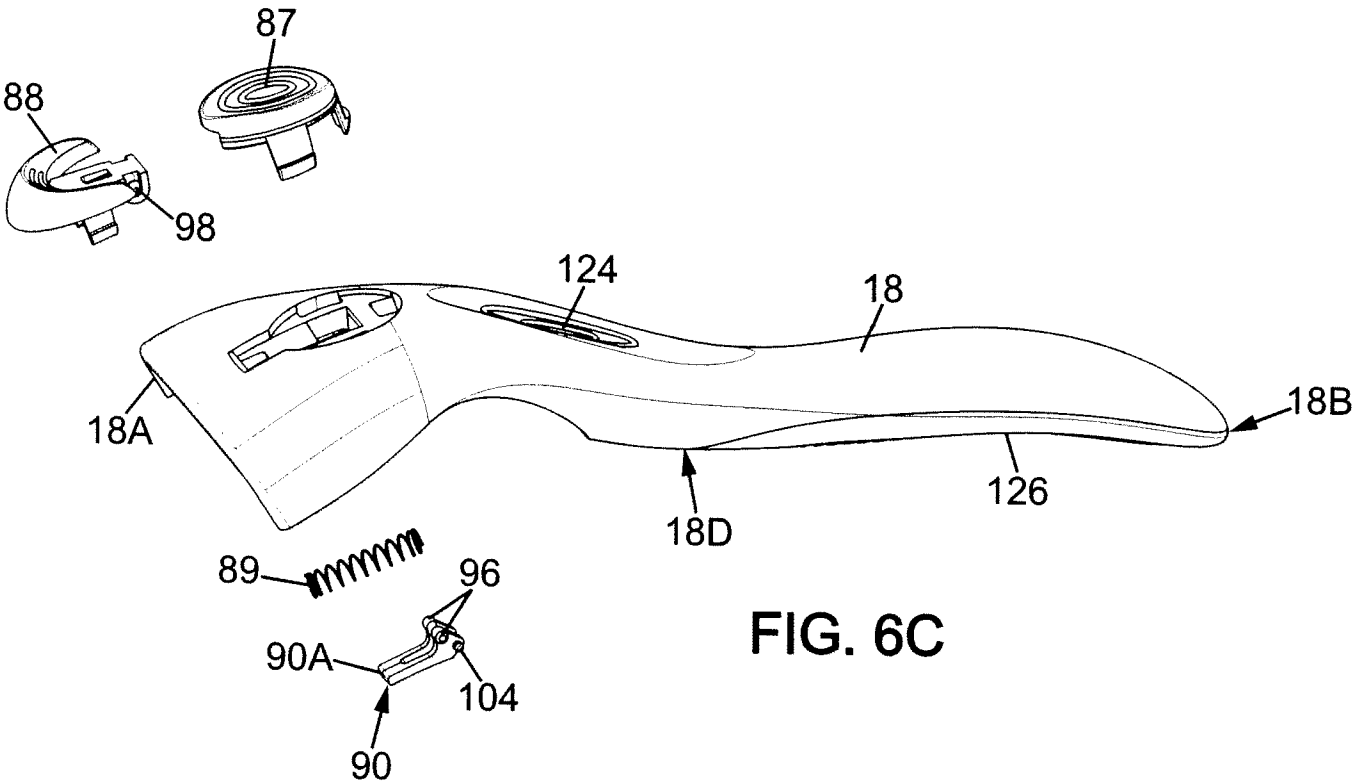
FIG. 6C is a partial perspective view of the control mechanism.

In reference to FIGS. 6A-6C, the control member 90 is pivotally mounted on the release button 88 via at least two opposite pivots 96 provided on the control member 90 and lodged in corresponding swing-holes 98 provided on the release button 88.

The elongated body 18 further includes a guide 100 adapted for guiding the control member 90 so that it is in the retracted position (FIG. 6A) when the release button 88 is in the rest position and in the active position (FIG. 6B) when the release button 88 is in the release position. To this extent, the guide 100 has a surface 102 along which two opposite hubs 104 provided on the control member 90 are able to slide. The guide 100 preferably has also a groove 106 in which the hubs 104 are located when the control member 90 is in its retracted position (FIG. 6A). This groove 106 is located in the rear of the surface 102 (opposite to the front end 18A of the body 18) and tilts the free end 90A of the control member 90 toward the top (toward the release button 88).

When the release button 88 slides forward (toward the front end 18A) toward its release position, the hubs 104 leave the groove 106 and slide along the surface 102 parallel to the longitudinal direction L, such that the control member 90 pivots about the hubs 104 and its free end 90A tilts toward the bottom (opposite to release button 88) deviating from the release button 88 (see FIG. 6B) of a tilting angle comprised between 15° and 30°, preferably of about 17.5°.

The value of this tilting angle is chosen according to the curvature of the handle, such that the front end 90A of the control member 90 is positioned to act on the actuating member 28 when the shaving cartridge carrier 20 is in the shaving position.

As illustrated in FIGS. 7A to 7D, according to the position of the shaving cartridge carrier 20, the control member 90 and especially its free end 90A is or not in register with the actuating member 28.

Figure 7A:
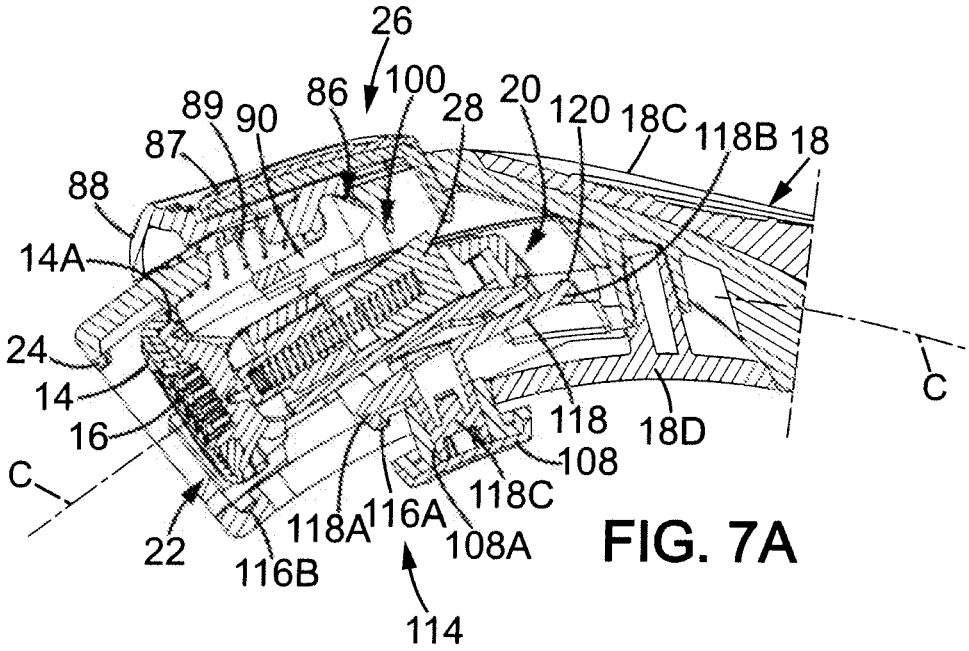
FIG. 7A' is a partial longitudinal section of the razor of FIG. 1C, the shaving cartridge carrier being in the non-shaving position and the release button being in the rest position.
Figure 7A:
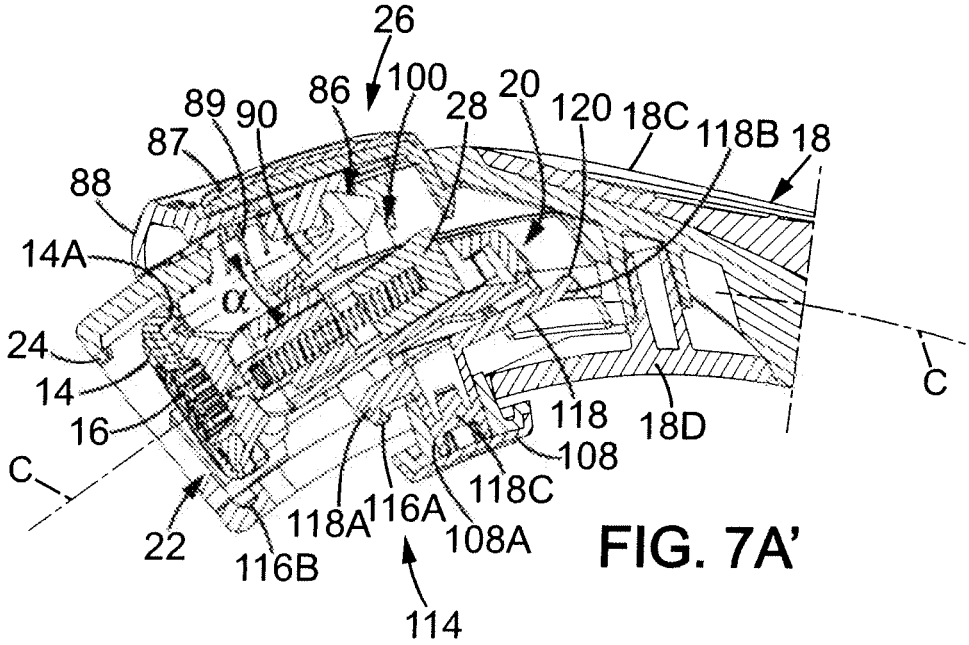
Figure 7B:
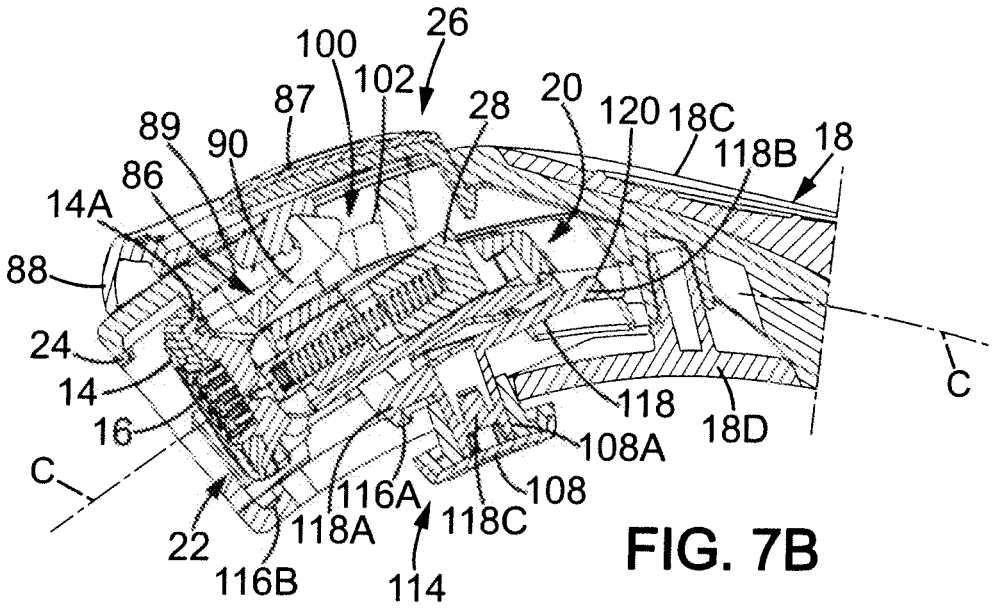
FIG. 7B is a partial longitudinal section of the razor of FIG. 1C, the shaving cartridge carrier being in the non-shaving position and the release button being in the release position.
Figure 7D:
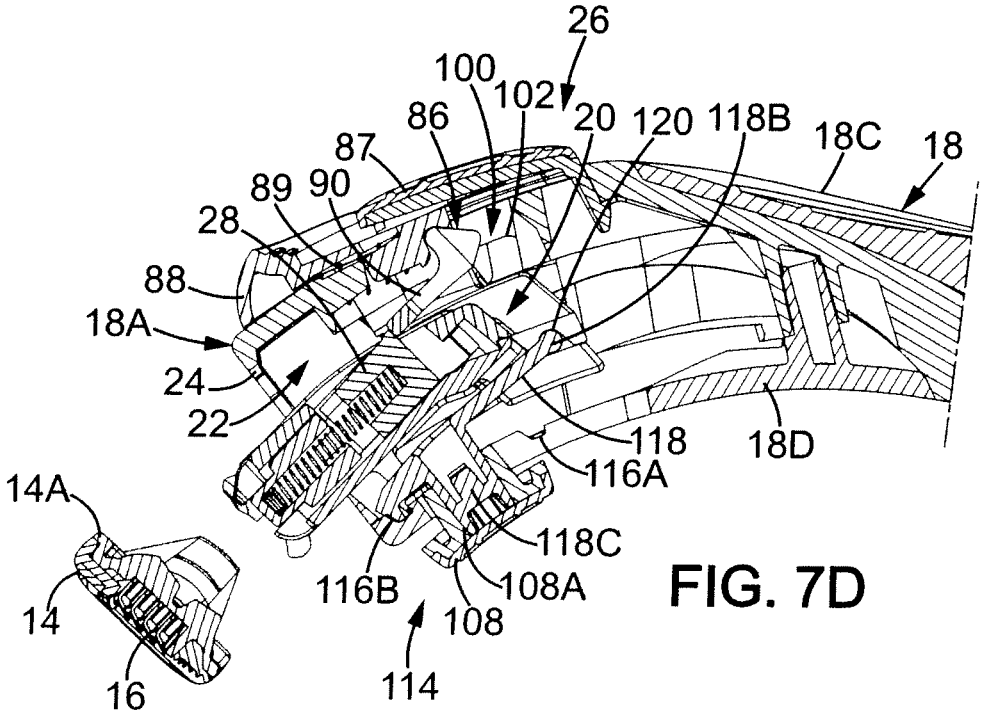
FIG. 7D is a partial longitudinal section of the razor of FIG. 1A, the shaving cartridge carrier being in the shaving position and the release button being in the release position.
Figure 7C:
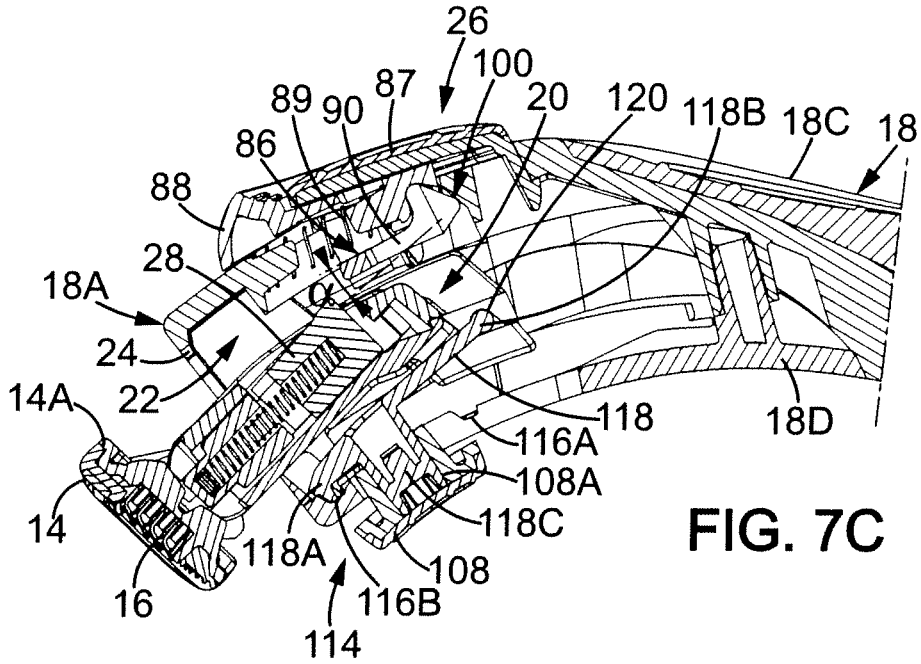
FIG. 7C is a partial longitudinal section of the razor of FIG. 1B, the shaving cartridge carrier being in the shaving position and the release button being in the rest position.
Figure 7C:
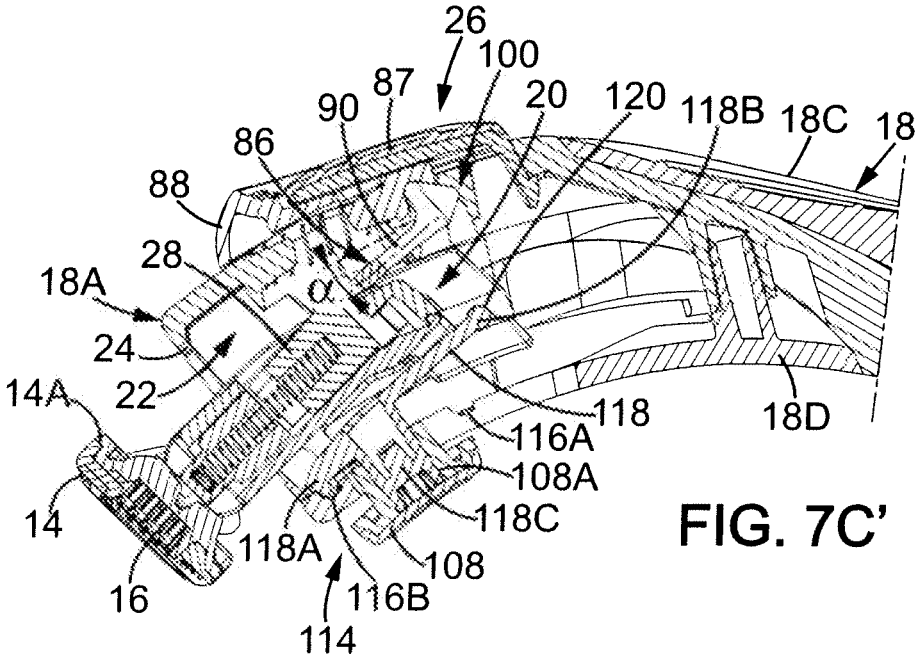

When the control member 90 is in its rest position (the release button 88 being in its rest-position), the shaving cartridge carrier 20 being in its non-shaving position as illustrated on FIG. 7A or in its shaving position as illustrated on FIG. 7C, the free end of the control member 90 is lifted up and distant from the shaving cartridge carrier 20 and can thus not act on it.

When the release button 88 slides toward its release-position, the control member 90 pivots in its active position (FIG. 7A' or 7C') and the free end 90A of the control member 90 is tilted toward the shaving cartridge carrier 20.

In this case, when the shaving cartridge carrier 20 is in its non-shaving position as illustrated on FIG. 7B, the control member 90 can still not act on it. In fact, the free end of the control member 90 is located above the shaving cartridge carrier 20 and the control member 90 slides with it without pushing any member. In the release-position, the free end 90A of the control member 90 is just back the shaving cartridge 14 (without contact).

When the shaving cartridge carrier 20 is in its shaving position as illustrated on FIG. 7D, the control member 90 can act on it. In fact, the free end 90A of the control member 90 is located in register with the shaving cartridge carrier 20. Thus, when the release button 88 continues to slide toward its release-position the control member 90 slides with it and pushes the actuating member 28 forward toward the front end 18A of the body 18. Consequently, the shaving cartridge 14 is released as above-explained.

In fact, coming back to FIG. 4A-4C, when a shaving cartridge 14 is mounted on the handle 12, the release mechanism 26 is normally in the cartridge lock position. Starting from this position, when a user wishes to exchange shaving heads, he first pushes the release button 88 forward, which brings the arm 30 toward each other against the camming action of the actuating member 28. During this movement, the actuating member 28 slides along the medial axis X toward the plunger 56, and the actuating member 28 partially penetrates between the ribs 72 of the plunger. When the arms 30 have sufficiently moved toward each other to reach the cartridge release position shown in FIG. 4A, the shaving cartridge 14 is released by the shell bearings 32 and is simultaneously ejected by the plunger 56.

The plunger 56 then moves forward to an outwardly protruding position, so that the detents 64 of the plunger penetrate in the recesses 68 of the extensions 66 of the arms. In this position, the arms 30 are maintained in the cartridge release position by abutment of the rims 70 against the detents 64, thus cooperating by hooking action. Afterwards, when a new shaving cartridge 14 is fixed to the handle 12, the shell bearings 32 are inserted between the arcuate slots 36 of the new shaving cartridge 14 and the cam surface 50 of the new shaving cartridge 14 pushes the plunger 56 backward toward the handle 12. The arms 30 are then released and deviate away from each other under the action of the actuating member 28, so that the shell bearings 32 insert themselves in the arcuate slots 36 of the new shaving cartridge 14, and the release mechanism 26 is again in the position shown in FIGS. 4B, 7A and 7C.

As illustrated on the figures, the release button 88 may be provided on the upper face 18C of the body 18 and a finger rest pad 87 can be further provided on the upper face of the body near the release button 88. Thus, when a user wants to release the shaving cartridge 14, he just has to put one of his fingers on the finger rest pad 108 and slide his finger forward, toward the front end 18A of the body 18, to push the release button 88 toward its release position.

The razor handle 12 further comprises a carrier button 108 slidably mounted in the longitudinal direction L for controlling the shaving cartridge carrier 20 motion. This carrier button 108, preferably provided on the lower face 18D of the body 18, is movable between a first position (see FIGS. 7A, 7A' and 7B) in which the shaving cartridge carrier 20 is in the non-shaving position and a second position (see FIGS. 7C, 7C' and 7D) in which the shaving cartridge carrier 20 is in the shaving position. The second position of the carrier button 108 may be closer to the front end 18A of the elongated body 18 than the first position.

Consequently, when a user wants to shave, he just has to push the carrier button 108 forward, toward its second position and the shaving cartridge carrier 20 slides toward the front end 18A through the opening 24 until it reaches its shaving position (see FIG. 1B).

As illustrated on FIGS. 2 and 3, the release-mechanism 26 may be partly confined inside the shaving cartridge carrier 20 formed by an upper part 20A assembled to a lower part 20B. In this case, the lateral flanges 21 are also formed in at least two corresponding parts 21A and 21B respectively provided on the upper part 20A and on the lower part 20B.

The shaving cartridge carrier 20 may have guide wings in order to guide its sliding inside the housing 22 along longitudinal direction L. In particular, at least two upper guide wings 110 can be provided on the upper part 20A and engaged in at least two corresponding longitudinal rails (not illustrated) provided on the inner surface of the upper shell 22A of the housing 22. In addition, three lower guide wings 112 can also be provided on the lower part 20B of the shaving cartridge carrier 20 and engaged in three corresponding longitudinal rails (not illustrated) provided on the inner surface of the lower shell 22B of the housing 22.

The razor handle 12 further comprises a locking mechanism 114 adapted to lock the shaving cartridge carrier 20 either in its non-shaving or in its shaving position. The carrier button 108 may be able to actuate the locking mechanism 114 to unlock the shaving cartridge carrier 20 from the non-shaving position or from the shaving position.

The locking mechanism 114 may comprise at least two recesses 116A and 116B provided on the housing 22, for example in the lower face 18A of the razor handle, and a spring tongue 118 connected to the carrier button 108 and to the shaving cartridge carrier 20. The spring tongue 118 has a free end 118A which can be retained in one of the two recesses 118A or 118B. The spring tongue 118 has an opposite free end 118B which is engaged in a recess 120 provided on the upper part 20A of the shaving cartridge carrier 20.

The spring tongue 118 preferably_has further a middle extension 118C on which the carrier button 108 is fixed. In fact, the carrier button 108 preferably has a central blind hole 108A in which the middle extension 118C is engaged. It follows that when the carrier button 108 is slid toward its second position, the spring tongue 118 is also moved forward and the shaving cartridge carrier 20 slides toward its shaving position (FIGS. 7C and 7D). In order to unlock the shaving cartridge carrier 20 from its non-shaving or shaving position, the carrier button 108 has to be pushed toward the inside of the housing 22 in order to release the free end 118A from the corresponding recess 118A or 118B.

The spring tongue 118 may be preloaded before mounting in the razor handle such that it is elastically brought back against the corresponding recess or the lower face 18A, when the carrier button 108 is released.

Hence, when the shaving cartridge carrier 20 is in its non-shaving position (see FIG. 7A and 7B), the free end 118A is located in the recess 116A, whereas when the shaving cartridge carrier 20 is in its shaving position (see FIGS. 7C and 7D), the free end 118A is located in the recess 116B, the recess 116B being closer to the front end 18A than the recess 116A.

In order to be able to release a shaving cartridge disclosed previously with help of the release button 88, the shaving cartridge carrier 20 has to be in its shaving position.

In fact, when the release button 88 begins to slide forward, the control member 90 pivots from its retracted position (FIG. 7A) to its active position (FIG. 7A'). However, when shaving cartridge carrier 20 is in its non-shaving position (the shaving cartridge 14 is located inside the housing 22) as depicted in detail on FIGS. 7A-7B, even when the release button 88 continue to be slid forward toward its release position (FIG. 7B), the control member 90 is neither able to contact, nor to push forward the actuating member 28 of the shaving cartridge carrier 20. In fact, the actuating member 28 is located too backward relative to the free end 90A of the control member 90. Consequently, the shaving cartridge can not be released.

On the contrary, when the shaving cartridge carrier 20 is previously put in its shaving position (the shaving cartridge 14 is located outside the housing 22) as depicted in detail on FIGS. 7C-7D and the release button 88 begins to slide forward, the control member 90 pivots from its retracted position (FIG. 7C) to its active position (FIG. 7C') and its free end 90A arrives just behind the actuating member 28. Hence, when the release button 88 continues to be slid forward toward its release position (FIG. 7D), the control member 90 slides forward and pushes the actuating member 28 of the shaving cartridge carrier 20 toward the front end 18A of the razor body 18. Consequently, as explained in detail above, the shaving cartridge 14 is released.

Thus, to release a shaving cartridge 14 connected to the razor handle 12, a user has to push and slide forward the carrier button 108 (for example with its thumb) in order to bring the shaving cartridge carrier 20 out of the housing 22 and then he has to slide forward the release button 88 (for example with its index) to release the shaving cartridge.

Figure 8A:
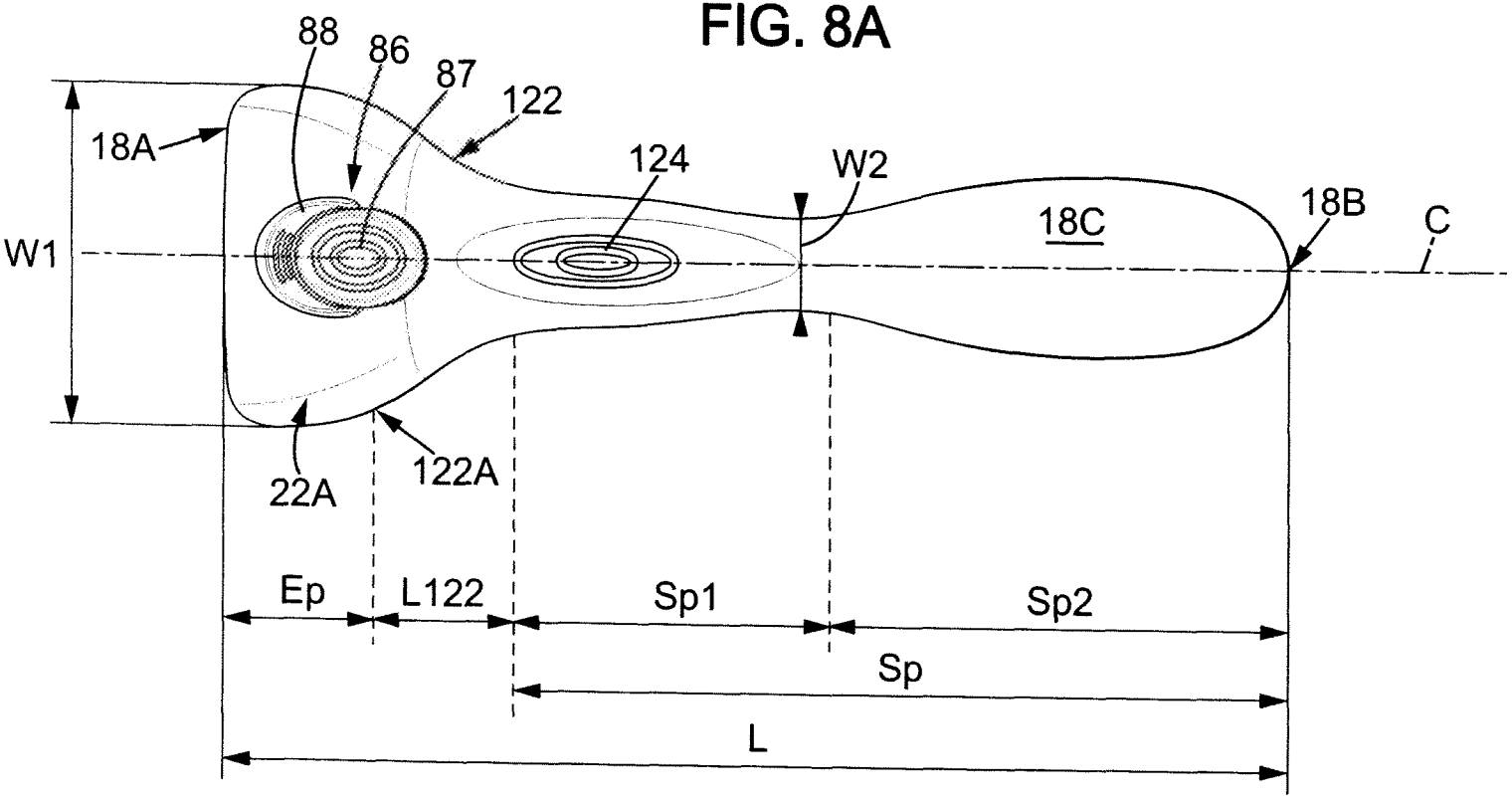
FIG. 8A is a top view of the shaving razor of FIG. 1C.
Figure 8B:
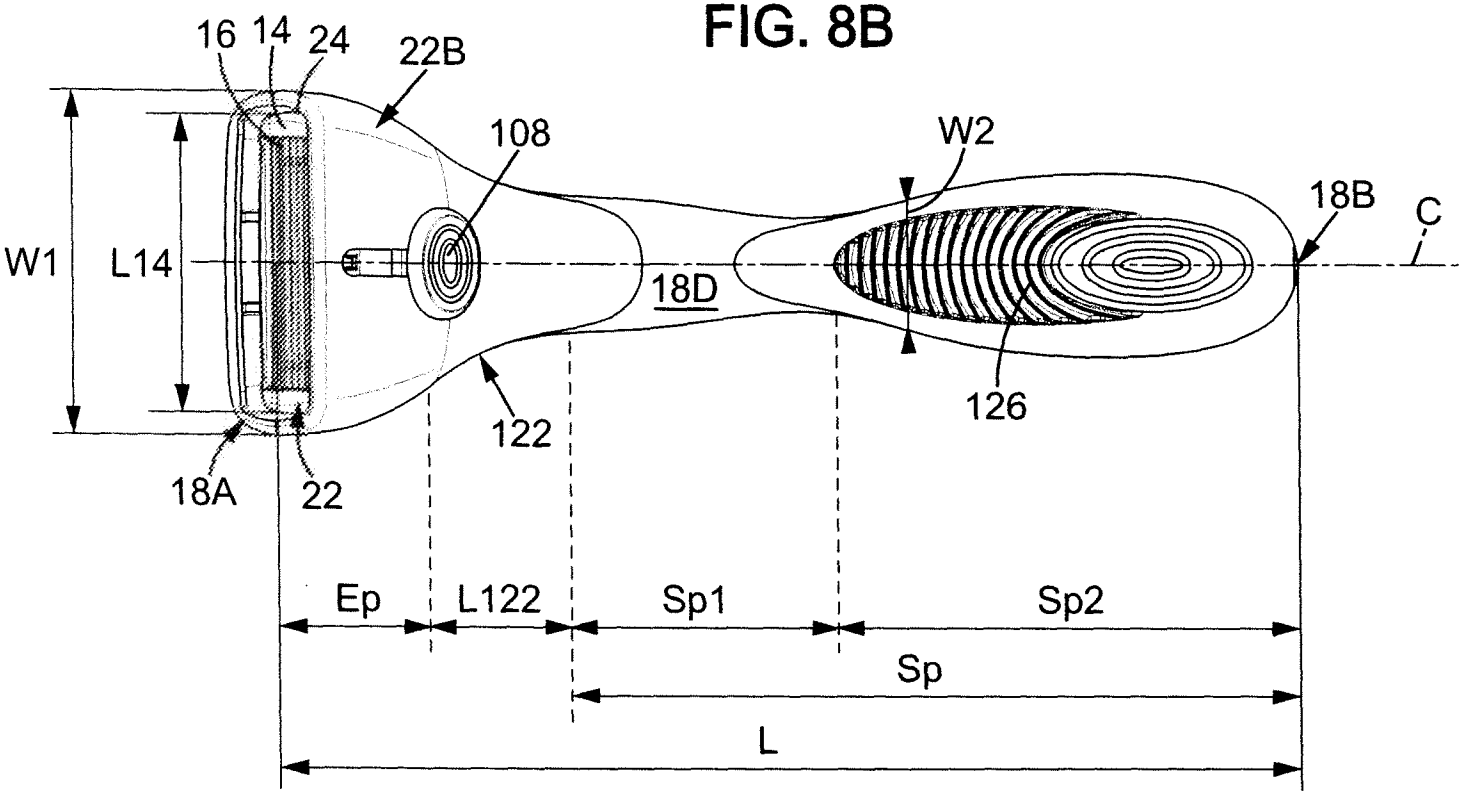
FIG. 8B is a bottom view of the shaving razor of FIG. 1C.

The elongated body 18 may define a variable width W along the length L thereof. As depicted on FIGS. 8A and 8B, the body comprising an enlarged part Ep having a width WI and a slim part Sp having a width W2 connected together by a neck 122. The enlarged part Ep extends from this neck 122 to the front end 18A, whereas the slim part Sp extends from the back end 18B to this neck 122.

Due to the geometry of the body, the neck 122 preferably has a widening shape which is broader on the side of the enlarged part Ep, the widen side 122A of the neck being located at about 15% of the overall length L from the front end 18A. For example, with a length L of the elongated body 18 comprised between 100 mm and 180 mm, preferably about 150 mm, the neck 122 is located between 20 mm to 40 mm from the front end 18A, preferably at about 30 mm.

In addition, the length L122 of the neck 122 and its widening are chosen according to the widths W1 and W2 such that the connection between the neck 122, the enlarged part Ep and the slim part Sp preferably has a smooth curvature. The neck 122 preferably has, for example, a length L122 comprised between 20 mm and 40 mm, preferably about 30 mm.

The width W1 of the enlarged part Ep may be sensitively constant along the length thereof and have a value which is just superior to the length L14 of a shaving cartridge 14. The width W1 may be comprised between 40 mm and 50 mm, preferably 45 mm.

The width W2 of the slim part Sp may be variable along the length thereof. Especially, the slim part can comprise at least two parts: a first one Sp1 connected to the neck 122 which is slimmer than a second one Sp2 extending from the back end 18B. The first slim part Sp1 can be provided with a finger rest area 124 on the upper face 18C of the body, and the second slim part Sp2 can be provided with a finger rest area 126 on the lower face 18D of the body (see FIG. 8B), the finger rest areas 124 and 126 may be flexible gripping areas made of an injected moulded elastomeric material, whereas the rest of the handle can be substantially rigid backbone of an injected moulded thermoplastic, non elastomeric material.

The invention claimed is:

1. A razor handle for a retractable shaving cartridge comprising:

an elongated body extending in a longitudinal direction between a front end and a back end, and having an upper and a lower face, the body having a hollow housing provided with an opening at the front end of the body, a shaving cartridge carrier movable between a shaving position in which the razor cartridge carrier extends at least partly out of the housing, and a non-shaving position in which the razor cartridge carrier is retracted inside the housing, a release mechanism provided on the shaving cartridge carrier and including an actuating member which is adapted to actuate the release mechanism so as to release a shaving cartridge carried by the shaving cartridge carrier, and a control mechanism which is disposed on the body for controlling the actuating member only when the shaving cartridge carrier is in the shaving position, the control mechanism comprising a release button movably mounted on the elongated body between a rest position and a release position, the control mechanism further comprising a control member movably mounted between a retracted position in which the control member does not interfere with the actuating member of the release mechanism and an active position in which the control member is positioned to act on the actuating member upon actuation of the release button when the shaving cartridge carrier is in the shaving position, wherein the control member is pivotally mounted relative to the release button, and wherein the elongated body further includes at least a guide adapted for guiding the control member so that the control member is in the retracted position when the release button is in the rest position and the control member is in the active position when the release button is in the release position.

2. The razor handle according to claim 1, wherein the release button is slidably mounted in the longitudinal direction on the elongated body between the rest position and the release position, the release position being closer to the front end of the elongated body than the rest position and the release button being elastically biased toward the back end.

3. The razor handle according to claim 2, wherein the release mechanism comprises at least two arms for connecting a shaving cartridge to the shaving cartridge carrier, the arms extending substantially symmetrical on both sides of a medial axis, the arms being elastically biased opposite to one another toward a cartridge locking position and movable toward one another into a cartridge release position, and wherein the actuating member has at least two pins slidably engaged in at least two cam recesses provided on the arms and formed to allow the biasing of the arms toward the head locking position when the actuating member is pushed toward the front end of the body.

4. The razor handle according to claim 3, wherein the razor cartridge carrier further comprises lateral flanges extending forward at the front end of the body, at least as far as the two arms, the two arms being situated between the two lateral flanges.

5. The razor handle according to claim 1, further comprising a carrier button which is slidably mounted in the longitudinal direction on the elongated body for controlling the shaving cartridge carrier motion, the carrier button being movable between a first position in which the shaving cartridge carrier is in the non-shaving position and a second position in which the shaving cartridge carrier is in the shaving position, the second position being closer to the front end of the elongated body than the first position.

6. The razor handle according to the claim 5, wherein the release button is provided on the upper face of the body, whereas the carrier button is provided on the lower face of the body, and wherein a finger rest pad is provided on the upper face of the body near the release button.

7. The razor handle according to claim 6, further comprising a locking mechanism adapted to lock the shaving cartridge carrier either in the non-shaving or in the shaving position, the carrier button being able to actuate the locking mechanism to unlock the shaving cartridge carrier from the non-shaving position or from the shaving position.

8. The razor handle according to claim 7, wherein the locking mechanism comprises at least two recesses provided on the housing and a spring tongue connected to the carrier button and to the shaving cartridge carrier, the spring tongue having a free end which is retained in one of the two recesses when the shaving cartridge carrier is in the non-shaving position, and in the other of the two recesses when the shaving cartridge carrier is in the shaving position.

9. The razor handle according to claim 1, wherein the body has a variable width along a length, the body comprising an enlarged part and a slim part connected together by a neck, the neck being located at a distance from the front end which is comprised between 10% and 20% of an overall length of the razor handle, the enlarged part extending from the neck to the front end, whereas the slim part extends from the back end to the neck.

10. A razor comprising a razor handle according to claim 1 and a shaving cartridge connected to the shaving cartridge carrier.

11. The razor according to claim 10, wherein the shaving cartridge is connected to the shaving cartridge carrier such that the shaving cartridge extends out of the razor handle when the shaving cartridge carrier is in the shaving position and the shaving cartridge is located inside the housing when the shaving cartridge carrier is in the non-shaving position, and wherein the release mechanism is adapted to release the shaving cartridge only when the shaving cartridge carrier is in the shaving position.

12. The razor according to the claim 11, wherein the shaving cartridge is provided with rearwardly protruding ribs where the rearwardly protruding ribs are capable of being connected to the razor handle such that the rearwardly protruding ribs partly covers-the two lateral flanges of the razor handle when the shaving cartridge is connected to the shaving cartridge carrier.

* * * * *